US010806959B2

(12) United States Patent
Naidus

(10) Patent No.: US 10,806,959 B2
(45) Date of Patent: Oct. 20, 2020

(54) LEG PRESS MACHINE WITH A WEIGHT PLATE TRANSFER SYSTEM FOR REDUCING EXERCISE RESISTANCE WHILE REMAINING SEATED

(71) Applicant: Scott G. Naidus, Manchester, NH (US)

(72) Inventor: Scott G. Naidus, Manchester, NH (US)

( * ) Notice: Subject to any disclaimer, the term of this patent is extended or adjusted under 35 U.S.C. 154(b) by 26 days.

(21) Appl. No.: 16/121,610

(22) Filed: Sep. 4, 2018

(65) Prior Publication Data

US 2019/0070449 A1 Mar. 7, 2019

Related U.S. Application Data

(60) Provisional application No. 62/553,391, filed on Sep. 1, 2017.

(51) Int. Cl.
*A63B 21/00* (2006.01)
*A63B 21/062* (2006.01)
(Continued)

(52) U.S. Cl.
CPC ..... *A63B 21/00076* (2013.01); *A63B 21/062* (2013.01); *A63B 21/0628* (2015.10);
(Continued)

(58) Field of Classification Search
CPC ..... A63B 21/00076; A63B 21/06281; A63B 21/0628; A63B 21/4034; A63B 21/00065;
(Continued)

(56) References Cited

U.S. PATENT DOCUMENTS 4,205,838 A * 6/1980 McIntosh ..... A63B 21/078 482/104
5,616,108 A 4/1997 Hayden
5,772,561 A 6/1998 Hayden
5,827,154 A * 10/1998 Gill ..... A63B 21/153 482/9

(Continued)

OTHER PUBLICATIONS

Website: https://www.roguefitness.com/rogue-horizontal-plate-racks Rogue Horizontal Plate Rack 2.0.

(Continued)

*Primary Examiner* — Loan B Jimenez
*Assistant Examiner* — Andrew M Kobylarz
(74) *Attorney, Agent, or Firm* — Russ Weinzimmer & Associates, P.C.

(57) ABSTRACT

A leg press machine with a weight plate transfer mechanism to reduce exercise resistance while remaining seated on the machine. Weight plates are movably supported within a sliding housing, rather than being received on a pair of side pegs, as in conventional leg press machines. One of the weight plates can be pushed to roll from the sliding housing to a storage housing by the exerciser using a weight transfer actuator, allowing the exerciser to reduce the exercise resistance conveniently while remaining seated. The storage housing is positioned with an open side facing an open side of the sliding housing so as to receive the weight plate pushed and rolled from the sliding housing. Additionally, by positioning the storage housing at substantially the same height as the sliding housing, the exerciser can easily roll one or more weight plates between the two housings so as to reduce the exercise resistance.

19 Claims, 7 Drawing Sheets

(51) Int. Cl.
*A63B 23/04* (2006.01)
*A63B 71/00* (2006.01)
*A63B 71/06* (2006.01)

(52) U.S. Cl.
CPC ..... *A63B 21/4034* (2015.10); *A63B 21/4045* (2015.10); *A63B 23/0417* (2013.01); *A63B 21/00065* (2013.01); *A63B 21/4033* (2015.10); *A63B 23/04* (2013.01); *A63B 2071/0072* (2013.01); *A63B 2071/0683* (2013.01); *A63B 2208/0233* (2013.01); *A63B 2208/0238* (2013.01)

(58) Field of Classification Search
CPC ..... A63B 23/0417; A63B 21/4045; A63B 21/062; A63B 2208/0238; A63B 2071/0072; A63B 2071/0683; A63B 21/4033; A63B 2208/0233; A63B 23/04; B42P 2241/24; B65B 5/00; B65B 5/04; B65B 5/06; B65B 5/08
See application file for complete search history.

(56) References Cited

U.S. PATENT DOCUMENTS

| | | | | |
|---|---|---|---|---|
| 6,220,993 | B1 | 4/2001 | Sencil | |
| 6,896,644 | B1 | 5/2005 | Voigt | |
| 7,001,314 | B1 | 2/2006 | Hummer, Jr. | |
| 2005/0192167 | A1* | 9/2005 | Shifferaw ..... | A63B 21/0615 482/94 |
| 2007/0049472 | A1 | 3/2007 | Hummer, Jr. | |

OTHER PUBLICATIONS

Website: http://www.movestrongfit.com/shop/wall-storage-plate-holder Wall Storage Plate Holder.
Website: https://www.ironcompany.com/horizontal-bumper-rack-legend-fitness Horizontal Bumper Plate Storage Rack—Legend Fitness (3163).
Website: https://lifefitness.com/facility/products/hammer-strength-plate-loaded/iso-lateral-leg-press Hammer Strength Plate-Loaded Iso-Lateral Leg Press.

* cited by examiner

LEG PRESS MACHINE WITH A WEIGHT PLATE TRANSFER SYSTEM FOR REDUCING EXERCISE RESISTANCE WHILE REMAINING SEATED

FIELD OF THE INVENTION

The present invention relates generally to exercise equipment, and particularly to leg press machines.

BACKGROUND OF THE INVENTION

A leg press machine is exercise equipment for performing leg exercises, specifically the "leg press". A leg press is a weight training exercise in which an exerciser pushes a weight or resistance away from himself or herself using his or her legs.

FIG. 2 illustrates a conventional leg press machine of the diagonal "sled" type. The leg press machine 100 includes a seat 101 mounted to a frame 110. Although the frames of leg press machines are known to have a wide variety of configurations, the frame 110 represents a typical frame having elements that are common in leg press machines, including a rectangular base 112 having front and rear ends 114, 116, respectively, a pair of vertical support members 118 attached to the front end 114 and projecting upward therefrom, and a pair of angled or inclined support members 120 extending between the upper ends 122 of the vertical support members 118 and opposite ends of the rear end 116 of the base 112.

A horizontal cross bar 124 is secured to, and extends between, the upper ends 122 of vertical support members 118. A pair of rails 102 positioned parallel and adjacent to the pair of angled or inclined support members 120 are secured to and extend between the horizontal cross bar 124 and the rear end 116 of the base 112. The rails 102 may be secured by bolts 106 or the like, as shown. A sliding cross bar 126 is slidably mounted on the rails 102. A foot rest 103 is secured to the sliding cross bar 126 such that the exerciser may sit in the seat 101 and push upward on the foot rest 103 during exercise. The sliding cross bar 126 is adjustably weighted to provide exercise resistance by removable weight plates 130, which are removably mounted on pegs 128, which are fixed to and extend outward from opposed ends of the sliding cross bar 126.

In use, if the exerciser wishes to add or remove weight to change the exercise resistance, the exerciser must stop exercising, get off the leg press machine 100, approach each side of the leg press machine 100, and slide each weight plate 130 onto or off of respective pegs 128. Moving unwanted weight plates 130 to storage to reduce exercise resistance, or adding desired additional weight plates 130 from storage, requires that the user interrupt use of the leg press machine 100, and then use his or her arms, and particularly his or her back, to move the weight plates 130. Thus, to adjust the exercise resistance of the leg press machine 100, the exerciser must interrupt the exercise, which can reduce the effectiveness of the exercise, and the exerciser risks putting strain on his or her arms and/or back while moving the weights 130 onto, or off of, respective pegs 128 of the leg press machine 100.

SUMMARY OF THE INVENTION

The leg press machine with a weight transfer system of the invention is similar in operation to a conventional 45° leg press machine, but with the weight plates carried within a sliding housing (also called an "exercise sled") that provides exercise resistance, rather than being mounted on a pair of side pegs. The present leg press machine includes a frame similar to that of a conventional 45° leg press machine, including a base, a pair of vertical support members secured to the front end of the base and projecting upward therefrom, and a pair of inclined support members extending between respective upper ends of the pair of vertical support members and the rear end of the base. A seat is mounted to the rear end of the base of the frame in a conventional manner. The seat position can be adjusted to accommodate exercisers of different heights. Additionally, a pair of rails are respectively mounted parallel and adjacent to the pair of inclined support members such that a sliding cross bar may be slidably mounted thereon.

The sliding housing is mounted on the sliding cross bar for removably receiving a plurality of weight plates. The sliding housing has an open front end, an open upper end, a closed rear end, a closed lower end, and a pair of sidewalls. A movable mount is disposed within the sliding housing adjacent one of the sidewalls, such that a single one of the weight plates (i.e., the weight plate closest to the sidewall) may be removably mounted thereon. A push rod is pivotally secured to the movable mount and at least partially projects through a slot formed through the sidewall.

A weight transfer actuator is used by the exerciser desiring to reduce the exercise resistance of the leg press machine to selectively push the push rod so as to eject the weight plate from the sliding housing. The weight transfer actuator has a fixed bar, a moving bar, and a pair of pivoting links, such that the fixed bar, the moving bar, and the pair of pivoting links define a parallelogram linkage. The moving bar has a top surface adapted for releasable engagement with the push rod. The fixed bar is mounted on one of the inclined support members of the frame, allowing the exerciser to use the weight transfer actuator when in the seated exercise position, eliminating the need to get off the machine to reduce the exercise resistance. Thus, using the weight transfer actuator, the exercise resistance can be reduced quickly soon after the exerciser has reached a state of exhaustion, and then the exerciser can continue the exercise, which would not have been possible at the original level of exercise resistance.

A storage housing is positioned directly in front of the frame to receive the weight plate ejected from the sliding housing. Additionally, by positioning the storage housing at the same height as the sliding housing, the exerciser can easily roll one or more weight plates from the sliding housing to the storage housing so as to reduce the exercise resistance. The storage housing has a closed front end, an open rear end, an open upper end, a closed lower end, and a pair of sidewalls. The storage housing has an adjustable height, allowing the open rear end of the storage housing to be aligned with the open front end of the sliding housing, thereby allowing a weight plate to roll from the front-facing sliding housing to the storage housing.

One general aspect of the invention is a leg press machine with a weight transfer system for reducing exercise resistance while remaining seated. The leg press machine includes: a frame having a base including a front end and a rear end, a pair of vertical support members secured to the front end of the base and projecting upward therefrom, the vertical support members each having an upper end, and a pair of inclined support members extending between the respective upper ends of the vertical support members and the rear end of the base; a seat adjustably mounted to the rear end of the base of the frame; a pair of rails mounted parallel and adjacent to the pair of inclined support members, respectively; a sliding cross bar slidably mounted on the pair of rails; a sliding housing secured to the sliding cross bar, the sliding housing having an open front end and a closed rear end, the sliding housing being configured to movably support a plurality of weight plates; and a storage housing having a closed front end and an open rear end, the storage housing being positioned such that the open rear end opens towards the open front end of the sliding housing, the storage housing being configured to receive and support at least one weight plate received from the sliding housing.

In some embodiments, the leg press machine further includes a sliding support plate configured to provide a bridge between the sliding housing and the storage housing to enable a weight plate to roll from the sliding housing to the storage housing.

In some embodiments, the leg press machine further includes a weight transfer actuator configured to cause a weight plate to roll from the sliding housing to the storage housing.

In some embodiments, the storage housing is configured to be adjustable in height so as to match the height of the sliding housing when the sliding housing is pushed upward along the pair of rails so as to reach a maximum extent of travel along the pair of rails.

In some embodiments, the sliding housing has a pair of opposing sidewalls extending between the front end and the rear end, at least one of the sidewalls having a slot defined therein, and the leg machine further includes: a movable mount disposed within the sliding housing, the movable mount having a side portion and a rear portion, the movable mount being configured urge a weight plate upward and forward; a push rod rotatably attached to the side of the movable mount adjacent the rear portion, the push rod at least partially projecting through the slot in the at least one sidewall of the sliding housing; and a weight transfer actuator having a fixed bar, a moving bar, and a pair of pivoting links defining a parallelogram linkage, the moving bar having a top surface selectively and releasably engaging the push rod to lift the rear portion of the movable mount so as to tip the weight plate forward and roll the weight plate from the sliding housing to the storage housing.

Another general aspect of the invention is a leg press machine with a weight transfer system for decreasing exercise resistance while remaining seated. This leg press machine includes: a frame having a pair of inclined support members; a seat adjustably mounted to the frame; a pair of rails mounted parallel and adjacent to the pair of inclined support members, respectively; a sliding cross bar slidably mounted on the pair of rails; a sliding housing mounted on the sliding cross bar, the sliding housing having an open front end, a closed rear end, and a pair of opposing sidewalls extending between the front end and the rear end, at least one of the sidewalls having a slot defined therein, the sliding housing being configured to movably carry a plurality of weight plates; a movable mount disposed within the sliding housing, the movable mount having a side and a rear portion, the movable mount being configured to urge one of the weight plates forward and upward; a push rod rotatably attached to the side of the movable mount adjacent the rear portion, and at least partially projecting through the slot in the at least one sidewall of the sliding housing; a storage housing having a closed front end and an open rear end, the storage housing being positioned such that the open rear end opens towards the open front end of the sliding housing, the storage housing being configured to receive and support at least one weight plate received from the sliding housing; and a weight transfer actuator having a fixed bar, a moving bar, and a pair of pivoting links defining a parallelogram linkage, the moving bar having a top surface configured to releasably engage the push rod so as to lift the rear portion of the movable mount so as to urge the weight plate forward, and thereby roll the weight plate from the sliding housing to the storage housing.

In some embodiments, the leg press machine further includes a sliding support plate configured to provide a bridge between the sliding housing and the storage housing so as to enable a weight plate to roll from the sliding housing to the storage housing.

In some embodiments, the storage housing is configured to be adjustable in height so as to substantially match the height of the sliding housing when the sliding housing is pushed upward along the pair of rails so as to reach a maximum extent of travel along the pair of rails.

In some embodiments, the frame further includes: a base including a front end and a rear end; and a pair of vertical support members secured to the front end of the base and projecting upward therefrom, each of the vertical support members having an upper end, the pair of inclined support members of the frame extending between the respective upper ends of the vertical support members and the rear end of the base.

Yet another general aspect of the invention is a leg press machine with a weight transfer system for reducing exercise resistance while remaining seated. This leg press machine includes: a frame having a pair of inclined support members; a pair of rails, each rail mounted to an inclined support member of the pair of inclined support members; a sliding cross bar slidably mounted on the pair of rails; a sliding housing mounted on the sliding cross bar, the sliding housing configured to receive and movably support at least one weight plate along the pair of rails up to a maximum extent of travel along the pair of rails; a storage housing positioned to receive a weight plate pushed from the sliding housing; and a weight transfer actuator configured to push a weight plate from the sliding housing, and cause the weight plate to roll from the sliding housing to the storage housing, thereby reducing the exercise resistance.

In some embodiments, the storage housing is configured to be positioned at a height determined by a maximum extent of travel of the sliding housing.

In some embodiments, the pair of inclined support members of the frame are slanted at 45°.

In some embodiments, the leg press machine further includes a seat adjustably mounted to the frame so as to accommodate a height of an exerciser.

In some embodiments, the sliding housing includes a movable mount configured to support a weight plate, the movable mount also being configured to be lifted so as to urge the weight plate to begin rolling towards the storage housing.

In some embodiments, the weight transfer actuator includes a push rod pivotally secured to the movable mount, the push rod being configured to push a weight plate from the sliding housing.

In some embodiments, the weight transfer actuator includes: a fixed bar; a moving bar; and a pair of pivoting links, such that the fixed bar, the moving bar, and the pair of pivoting links define a parallelogram linkage.

In some embodiments, the moving bar has a top surface configured to releasably engage the push rod.

In some embodiments, the fixed bar is mounted along one of the inclined support members of the frame.

In some embodiments, the storage housing is positioned at substantially the height reached by the sliding housing when the sliding housing is pushed upward along the pair of rails so as to reach a maximum extent of travel along the pair of rails.

In some embodiments, the seat adjustably mounted to the frame is configured to be adjusted so that the sliding housing can be pushed upward by an exerciser along the pair of rails so as to reach a maximum extent of travel along the pair of rails when the exerciser extends his or her legs to a maximum extent.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 2:
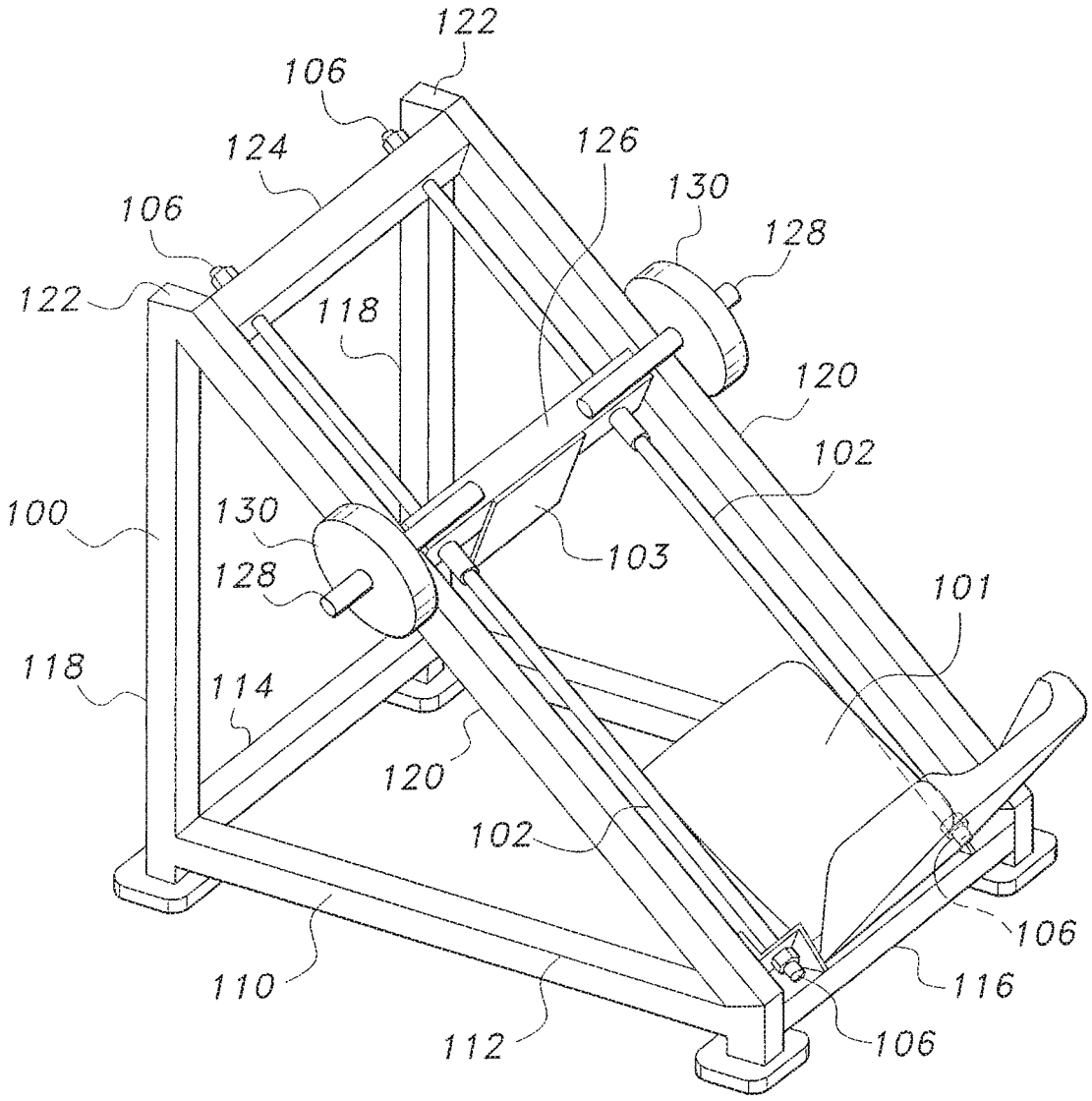
PRIOR ART FIG. 2
FIG. 2 is a perspective view of a prior art leg press machine.

An embodiment of the leg press machine with a weight transfer system 10 is similar in operation to a conventional 45° leg press machine, such as leg press machine 100 of FIG. 2, but with weight plates 30 carried within a sliding housing 28, rather than being received on a pair of side pegs.

Figure 1:
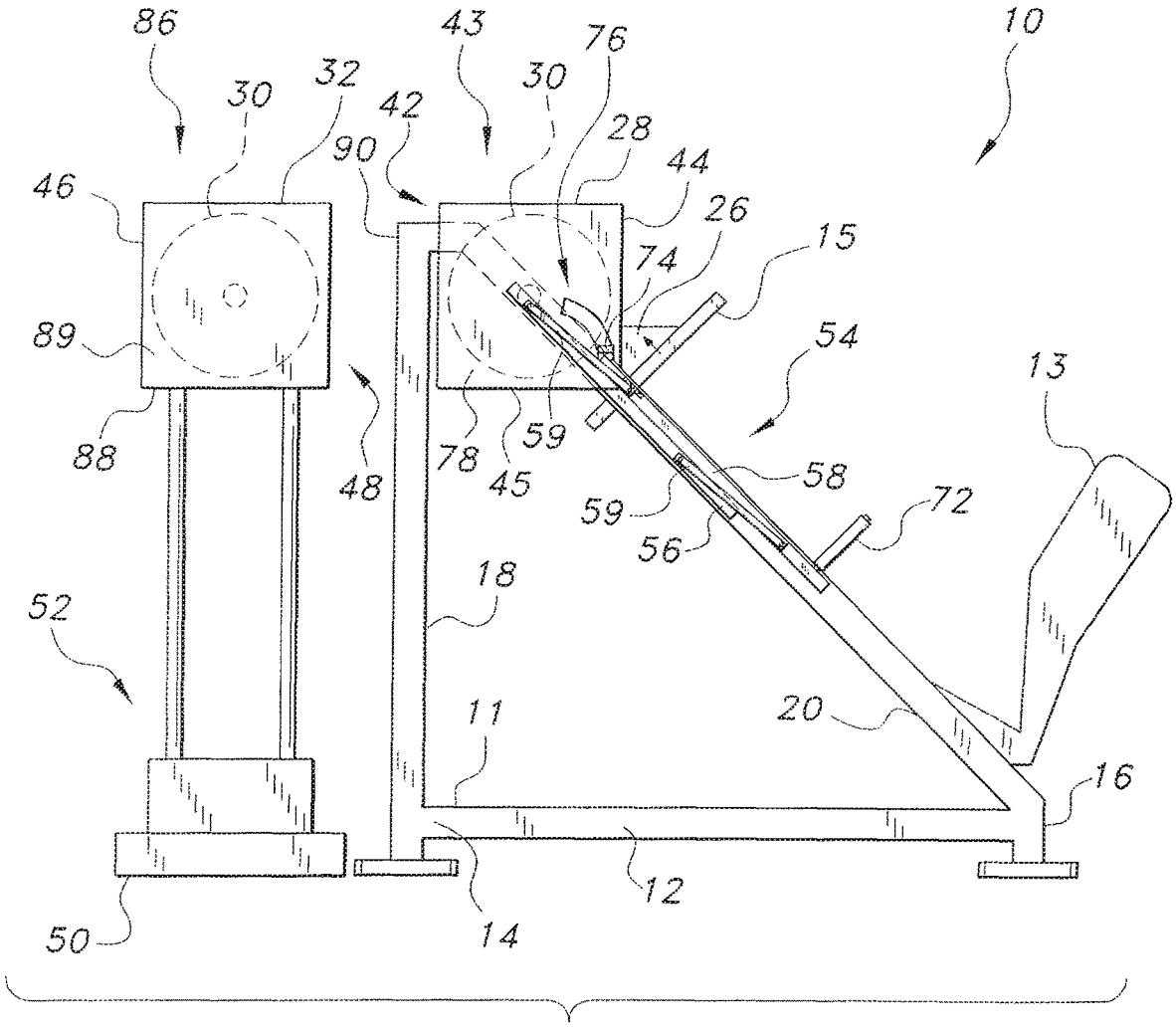
FIG. 1 is a side view of a leg press machine with a weight transfer system.
Figure 4:
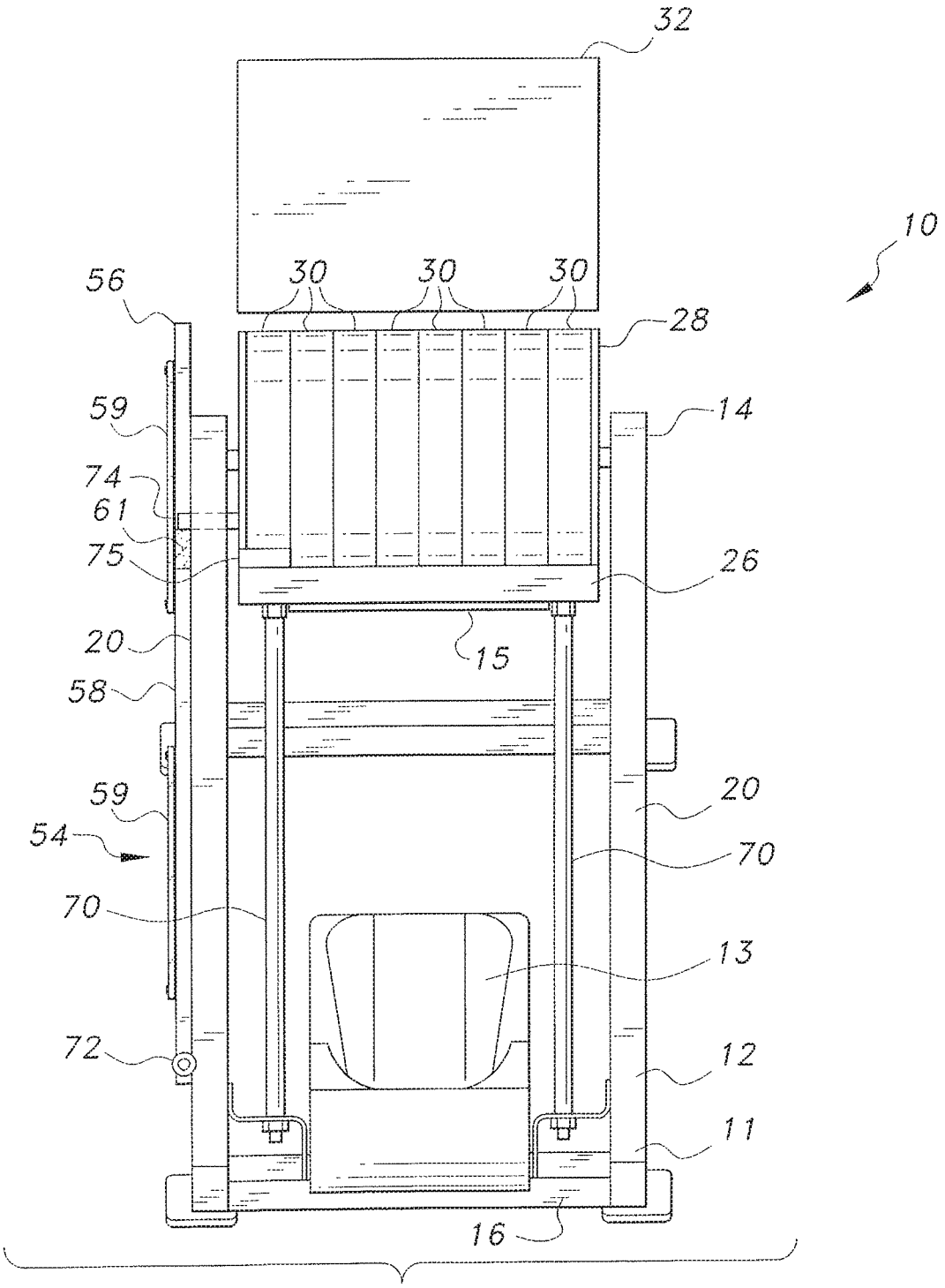
FIG. 4 is a top view of the leg press machine of FIG. 1.

As shown in FIGS. 1 and 4, the leg press machine with a weight transfer system 10 includes a frame 11 having a base 12, a pair of vertical support members 18 secured to the front end 14 of base 12 and projecting upward therefrom, and a pair of inclined support members 20 extending between respective upper ends 90 of the pair of vertical support members 18 and the rear end 16 of the base 12. A seat 13 is mounted to the rear end 16 of the base 12 of the frame 11 in a conventional manner. The seat 13 can be secured at various points along the pair of included support members 20 so as to accommodate exercisers of various heights.

Additionally, a pair of rails 70 are respectively mounted parallel and adjacent to the pair of inclined support members 20 such that a sliding cross bar 26 may be slidably mounted upon the pair of rails 70, similar to that of the conventional 45° leg press machine 100 of FIG. 2. A foot rest 15 is secured to the cross bar 26, allowing the exerciser to push the sliding cross bar 26 with his or her legs.

A sliding housing 28 is secured to the sliding cross bar 26 for removably receiving a plurality of weight plates 30. The weight plates 30 are preferably conventional circular weight plates, such as those used with a conventional 45° leg press machine. The sliding housing 28 has an open front end 42, an open upper end 43, a closed rear end 44, a closed lower end 45, and a pair of sidewalls 78.

Figure 3A:
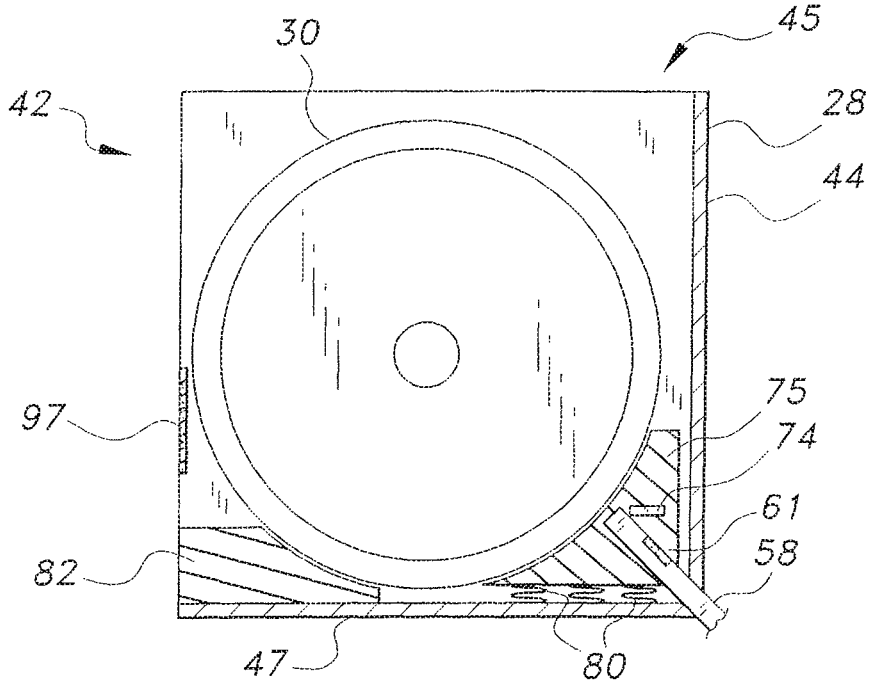
FIG. 3A is a side view in section of a sliding housing of the leg press machine of FIG. 1, shown with a weight plate at rest.
Figure 3B:
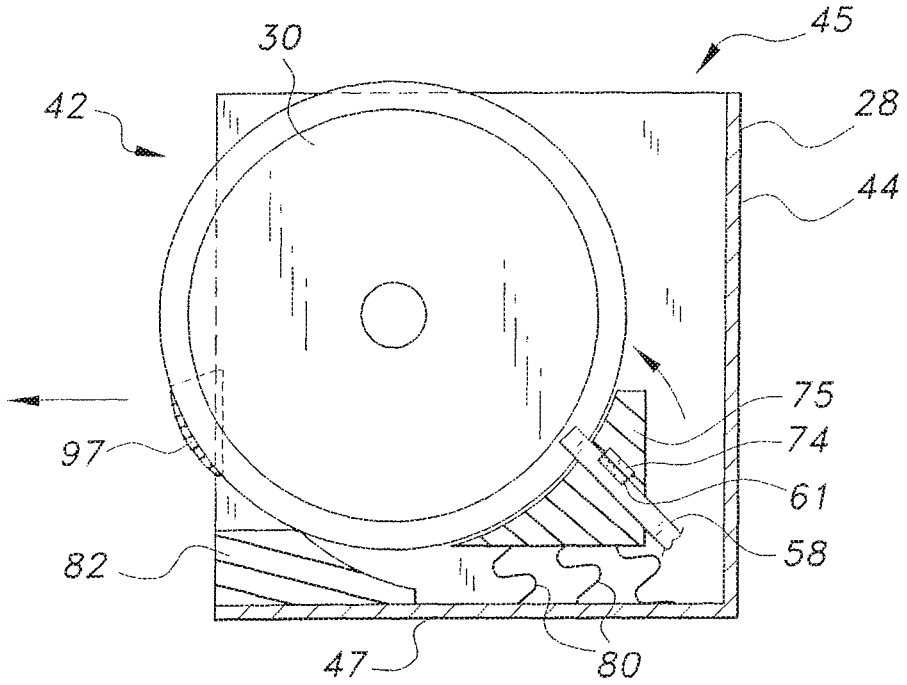
FIG. 3B is a side view in section of a sliding housing of the leg press machine of FIG. 1, shown in a configuration for ejecting a weight plate so as to reduce exercise resistance of the leg press machine.

As best seen in FIGS. 3A, 3B, and 4, a movable mount 75 is disposed within the sliding housing 28 adjacent one of the sidewalls 78, such that a single one of the weight plates (e.g., the weight plate closest to the sidewall) can be removably mounted thereon. A push rod 74 is pivotally attached to the movable mount 75 so that it is rotatable about a pin or swivel, and at least partially projects through a slot 76 formed through the sidewall 78.

In FIGS. 1 and 4, the movable mount 75, slot 76, and push rod 74 are shown positioned to the left side of the exerciser when the exerciser is in the seated exercise position. It should be understood that the selection of the left side is for exemplary purposes only, and that the movable mount 75, slot 76, and push rod 74 can alternatively be positioned on the right side of the exerciser when the exerciser is seated in seat 13. Alternatively, a movable mount 75, slot 76, and push rod 74 can be on both the right and left sides so that two weight plates can be removed from the sliding housing 28.

In this embodiment, the left-most one of weight plates 30 is in contact with movable mount 75 within the sliding housing 28, and the remainder of the weight plates 30 are only in contact with the closed lower wall 45 and one another, and the right-most weight plate is in contact with the other sidewall 78.

The weight plates 30 are removably held in place by a contoured lip or rim 82 to prevent them from accidentally falling out of the open front end 42. A weight transfer actuator 54 is used by the exerciser to selectively push the push rod 74 to eject the left-most weight plate 30 from the sliding housing 28 when the exerciser wants to reduce the exercise resistance in the amount of one weight plate.

Figure 5A:
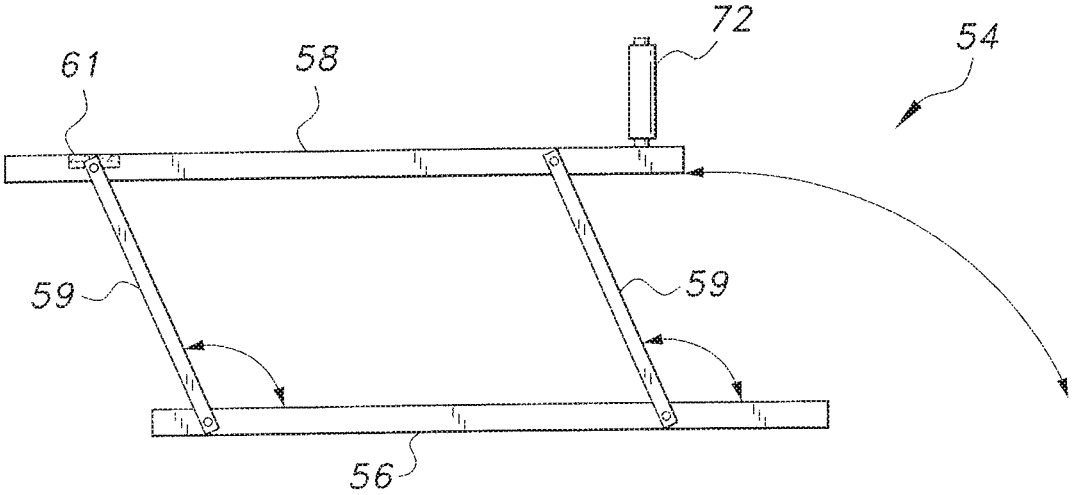
FIG. 5A is a side view of a weight transfer actuator of the leg press machine of FIG. 1, shown in an extended configuration.

As best seen in FIGS. 5A and 5 B, the weight transfer actuator 54 has a fixed bar 56, a moving bar 58, and a pair of pivoting links 59, such that the fixed bar 56, the moving bar 58, and the pair of pivoting links 59 define a parallelogram linkage, allowing the moving bar 58 to travel along an arcuate path of constant radius. A top surface of the moving bar 58 is preferably coated with rubber or the like, preferably adjacent the front end 61, allowing for secure releasable engagement with the push rod 74, which is also preferably coated with rubber or any other material having a high coefficient of friction to reduce slippage and ensure movement of the push rod 74 in the slot 76 when pushed by the moving bar 58. The fixed bar 56 is mounted on one of the inclined support members 20 of the frame 11, allowing the exerciser to use the weight transfer actuator 54 when in the seated exercise position. The weight transfer actuator 54 is mounted on the inclined support member 20 on the same selected side as the movable mount 75, slot 76, and push rod 74 (i.e., to the left of the seated exerciser in the example of FIGS. 1 and 4).

Figure 5B:
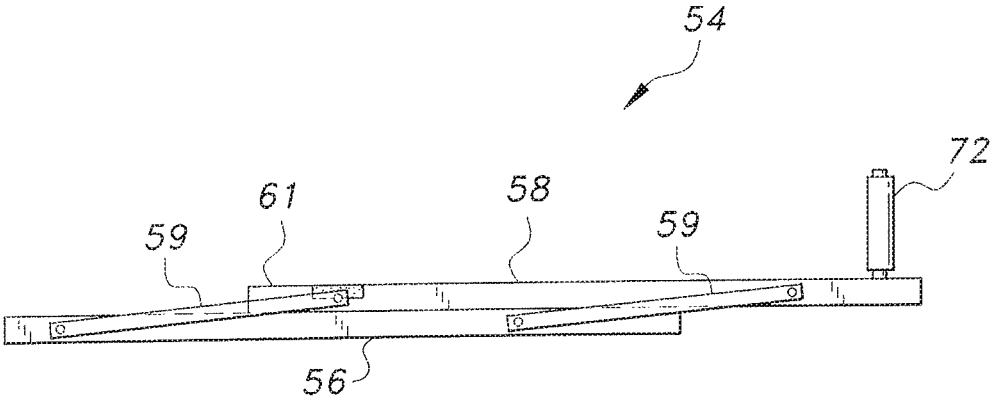
FIG. 5B is a side view of the weight transfer actuator of the leg press machine of FIG. 1, shown in a non-extended configuration.

A gripping handle 72 is secured to the moving bar 58, allowing the user to easily rotate the moving bar 58 from the collapsed position of FIG. 5B into the extended position of FIG. 5A. As shown in FIG. 3B, the rubber-coated top surface of the moving bar 58 of weight transfer actuator 54 selectively contacts the push rod 74.

Since a parallelogram linkage causes the moving bar 58 to travel along a semicircular path, the weight transfer actuator 54 initially begins in a fully collapsed non-extended position, such as that shown in FIGS. 1 and 5B. The rubber-coated top surface adjacent the front end 61 of the moving bar 58 is positioned under and contiguous to the push rod 74, and movement of the moving bar 58 lifts the push rod 74 to travel along a path of constant radius within the slot 76, which, as shown, defines a partial-circular arc. It should be understood that the push rod 74 is flat and is preferably pivotal or swiveling with respect to the movable mount 75, allowing for the rubber-coated top surface of the moving bar 58 to maintain contact with a larger surface area of the push rod 74 than merely the edge of the flat push rod 74 throughout its arcuate motion.

With the user urging the moving bar 58 forward and upward by pushing the handle 72, the push bar 74 is pushed upward along its constant radius, arcuate path (within the arcuate slot 76), thus lifting the rear portion of the movable mount and urging the movable mount 75 to tip forward, as shown in FIG. 3B. As shown, the movable mount 75 is preferably resiliently biased by springs 80 or the like. With sufficient force, the exerciser is able to tip the movable mount 75 with respect to the lower end 47 of the sliding housing 28 such that the left-most weight plate 30 (in this exemplary configuration) is pushed over the lip or rim 82 for ejection out of the sliding housing 28 through the open front end 42. Additionally, as shown in FIGS. 3A and 3B, the open front end 42 of the sliding housing 28 may have a rubber band 97, elastic band or the like stretched horizontally across (fixed to and extending between the sidewalls 78) the open front end 42. Although a weight plate 30 can easily roll over the rubber band 97, elastic band, or the like, as shown in FIG. 3B, the rubber band 97 gives sufficient resistance against accidental rolling that may be caused by vibration, motion of the sliding housing 28, small jolts, etc. It should be understood that a similar rubber band, elastic band, or the like may also stretch across the open rear end 48 of storage housing 32, as will be described in detail below.

A storage housing 32 is positioned directly in front of the frame 11 to receive the weight plate 30 ejected from the sliding housing 28. Alternatively, a sliding support plate 99 can provide a bridge between the sliding housing 28 and the storage housing 32, as shown and explained in FIG. 7 that allows the storage housing to be located at a convenient distance from the sliding housing 28 when the sliding housing 28 reaches the maximum extent of travel upward along the pair of inclined rails 70. The maximum extent of travel can be enforced by stop bumpers attached to the rails 70. The seat 13 can be adjusted along the rails 70 so that the maximum extent of travel substantially matches the maximum extension distance of the exerciser's legs.

Additionally, by positioning the storage housing 32 using the conventional pneumatic lift 52 (shown in FIG. 1) at the same height as the height of the sliding housing 28 when it reaches and is maintained by the exerciser at the maximum extent of travel upward along the pair of rails 70, the exerciser can easily roll one or more weight plates 30 between the two housings 28, 32. Thus, the leg press machine 10 of the invention enables the exerciser to reduce the exercise resistance immediately after exercise exhaustion has been reached, while remaining seated and with the exerciser's knees straight and legs fully extended so as to support the sliding housing 28 at a point of maximum travel upward along the pair of rails 70, while the user uses the weight transfer actuator 54 to roll a weight plate from the sliding housing 28 to the storage housing 32.

The storage housing 32 has a closed front end 46, an open rear end 48, an open upper end 86, a closed lower end 88, and a pair of sidewalls 89. The storage housing 32 has an adjustable height, allowing the open rear end 48 of the storage housing 32 to be aligned with the open front end 42 of the sliding housing 28. In FIG. 1, the storage housing 32 is shown mounted on a conventional pneumatic lift 52, which is positioned on a base 50 directly in front of the front end 14 of the base 12 of the frame 11. It should be understood that the pneumatic lift 52 is shown for exemplary purposes only, and that the storage housing 32 may be vertically adjusted by any suitable type of vertically adjustable mount, such as a hydraulic lift, a chain and pulley system, mechanical lift, a linear actuator, or the like.

Figure 6:
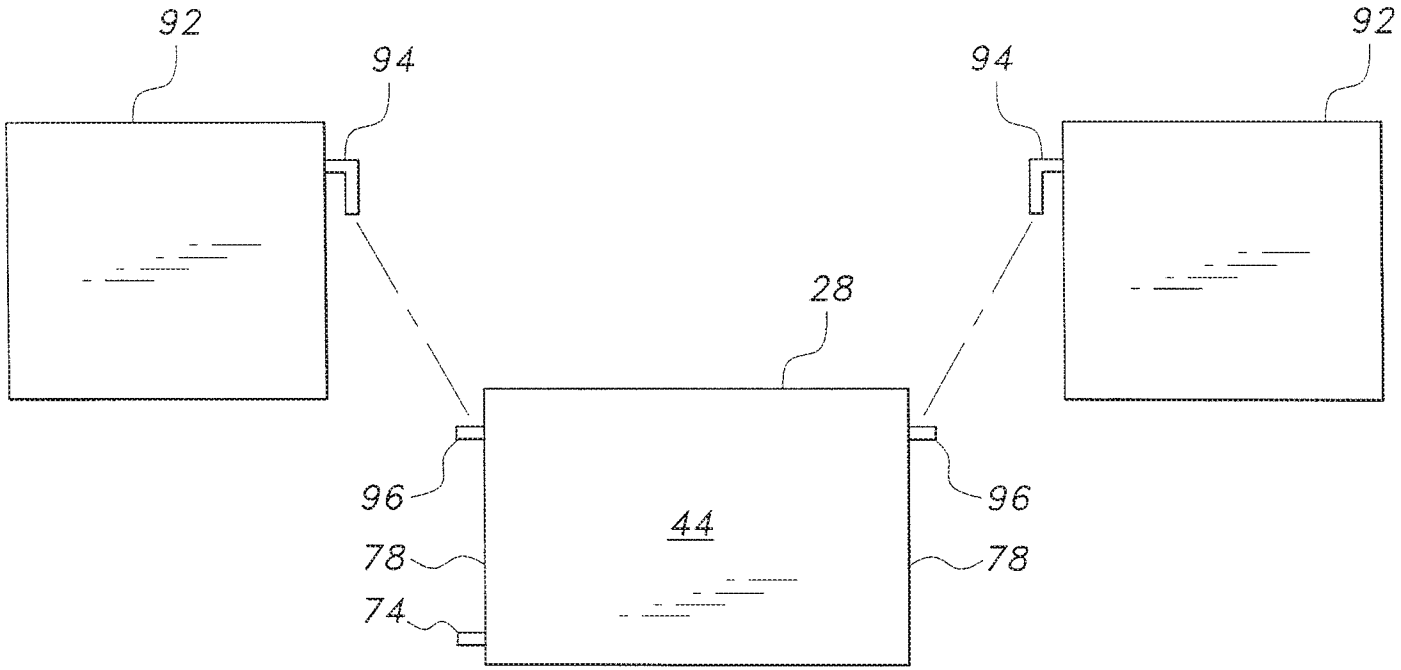
FIG. 6 is a rear view of a sliding housing along with additional add-on weight shelves of an alternative embodiment of a leg press machine with a weight transfer mechanism.
Figure 7:
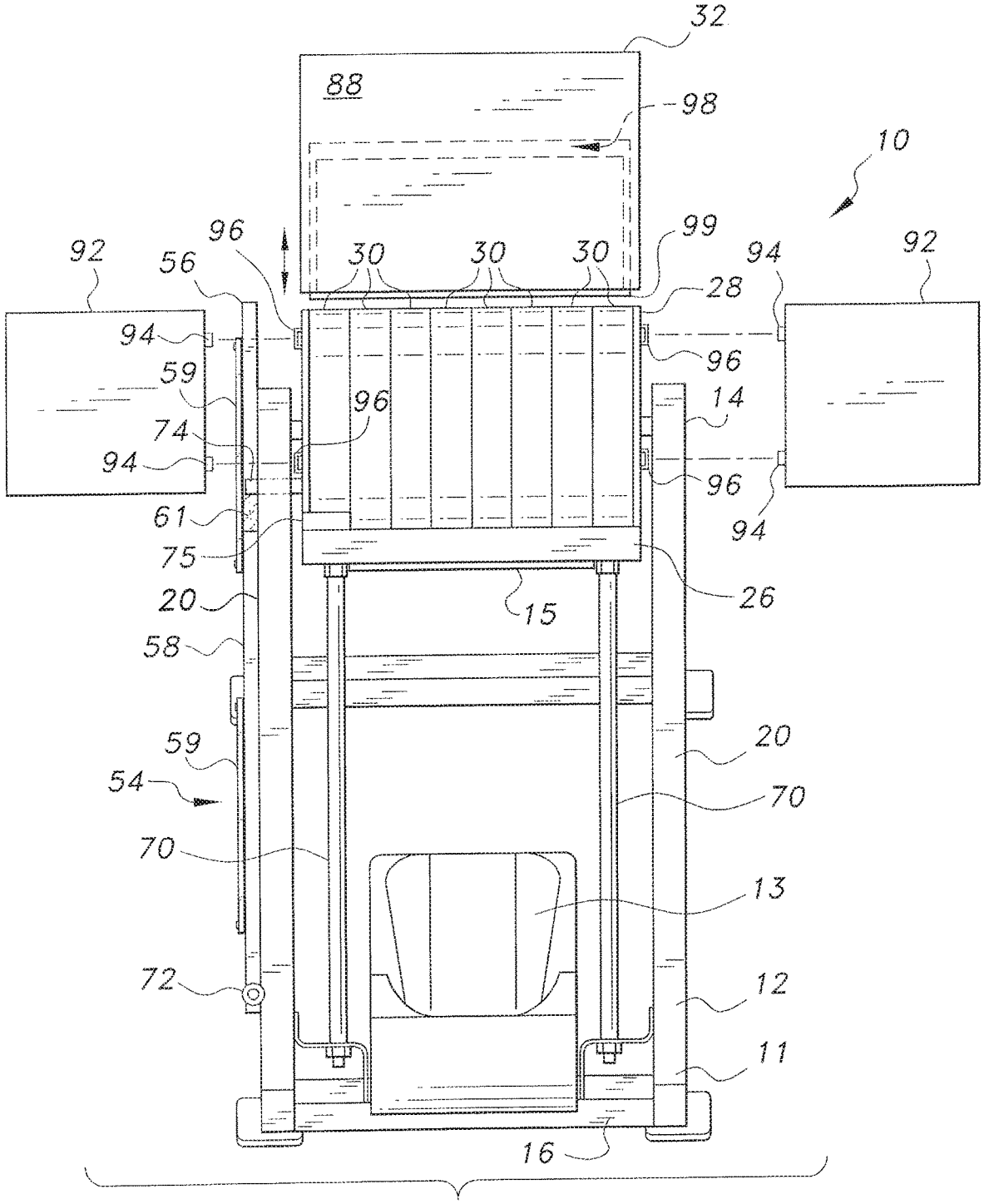
FIG. 7 is a top view of the alternative leg press machine of FIG. 6.

Additionally, as shown in the alternative embodiment of FIGS. 6 and 7, one or more add-on shelves 92 may be mounted on the sidewalls 78 of the sliding housing 28 (above the slot 76), allowing the exerciser to add more weight beyond the capacity of the interior of the sliding housing 28. As shown, brackets 96 may be secured to each sidewall 78, allowing the add-on shelves 92 to be removably mounted to the sliding housing 28 through engagement with hooks 94. It is important to note that the height of each add-on shelf 92 should be smaller than the height of the sidewalls 78, thus leaving clearance for the slot 76. Alternatively, brackets 96 and hooks 94 should be arranged at sufficient height to allow the add-on shelves 92 to clear the slot 76.

As shown in FIGS. 6 and 7, there may be two add-on shelves 92, one for each sidewall 78. It should be understood that the size requirement for the add-on shelf 92 to allow clearance for the slot 76 is only necessary for the add-on shelf 92 positioned above the slot 76. The other one of the add-on shelves 92 has no such size requirement, since the slot 76 is only formed through one of the sidewalls 78.

Further, as shown in FIG. 7, the closed lower end 88 of storage housing 32 may have a slot or cavity 98 for slidably receiving a sliding support plate 99. Since the distance between the storage housing 32 and the sliding housing 28 will be variable, the sliding plate 99 may be releasably withdrawn from the slot or cavity 98 to extend between the storage housing 32 and the sliding housing 28, allowing the weight plates 30 to be easily rolled between the sliding housing 28 and the storage housing 32.

It is to be understood that the leg press machine with a weight transfer system is not limited to the specific embodiments described above, but encompasses any and all embodiments within the scope of the generic language of the following claims enabled by the embodiments described herein, or otherwise shown in the drawings, or described above in terms sufficient to enable one of ordinary skill in the art to make and use the claimed subject matter.

Other modifications and implementations will occur to those skilled in the art without departing from the spirit and the scope of the invention as claimed. Accordingly, the above description is not intended to limit the invention, except as indicated in the following claims.

What is claimed is:

1. A leg press machine with a weight transfer system for reducing exercise resistance while remaining seated, the leg press machine comprising:

a frame having:

a base including a front end and a rear end;

a pair of vertical support members secured to the front end of the base and projecting upward therefrom, the vertical support members each having an upper end; and a pair of inclined support members extending between the respective upper ends of the vertical support members and the rear end of the base;

a seat adjustably mounted to the rear end of the base of the frame;

a pair of rails mounted parallel and adjacent to the pair of inclined support members, respectively;

a sliding cross bar slidably mounted on the pair of rails;

a sliding housing secured to the sliding cross bar, the sliding housing having an open front end and a closed rear end, the sliding housing being configured to movably support a plurality of weight plates;

a storage housing having a closed front end and an open rear end, the storage housing being positioned such that the open rear end opens towards the open front end of the sliding housing, the storage housing being configured to receive and support at least one weight plate received from the sliding housing; and a weight transfer actuator configured to cause the weight plate to roll from the sliding housing to the storage housing.

2. The leg press machine of claim 1, further including a sliding support plate configured to provide a bridge between the sliding housing and the storage housing to enable the weight plate to roll from the sliding housing to the storage housing.

3. The leg press machine of claim 1, wherein the storage housing is configured to be adjustable in height so as to match the height of the sliding housing when the sliding housing is pushed upward along the pair of rails so as to reach a maximum extent of travel along the pair of rails.

4. The leg press machine of claim 1, wherein the sliding housing has a pair of opposing sidewalls extending between the front end and the rear end, at least one of the sidewalls having a slot defined therein, the leg machine further comprising:

a movable mount disposed within the sliding housing, the movable mount having a side portion and a rear portion, the movable mount being configured urge the weight plate upward and forward; and a push rod rotatably attached to the side of the movable mount adjacent the rear portion, the push rod at least partially projecting through the slot in the at least one sidewall of the sliding housing, the weight transfer actuator having a fixed bar, a moving bar, and a pair of pivoting links defining a parallelogram linkage, the moving bar having a top surface selectively and releasably engaging the push rod to lift the rear portion of the movable mount so as to tip the weight plate forward and roll the weight plate from the sliding housing to the storage housing.

5. A leg press machine with a weight transfer system for decreasing exercise resistance while remaining seated, the leg press machine, comprising:

a frame having a pair of inclined support members;

a seat adjustably mounted to the frame;

a pair of rails mounted parallel and adjacent to the pair of inclined support members, respectively;

a sliding cross bar slidably mounted on the pair of rails;

a sliding housing mounted on the sliding cross bar, the sliding housing having an open front end, a closed rear end, and a pair of opposing sidewalls extending between the front end and the rear end, at least one of the sidewalls having a slot defined therein, the sliding housing being configured to movably carry a plurality of weight plates;

a movable mount disposed within the sliding housing, the movable mount having a side and a rear portion, the movable mount being configured to urge one of the weight plates forward and upward;

a push rod rotatably attached to the side of the movable mount adjacent the rear portion, and at least partially projecting through the slot in the at least one sidewall of the sliding housing;

a storage housing having a closed front end and an open rear end, the storage housing being positioned such that the open rear end opens towards the open front end of the sliding housing, the storage housing being configured to receive and support at least one weight plate received from the sliding housing; and a weight transfer actuator having a fixed bar, a moving bar, and a pair of pivoting links defining a parallelogram linkage, the moving bar having a top surface configured to releasably engage the push rod so as to lift the rear portion of the movable mount so as to urge the weight plate forward, and thereby roll the weight plate from the sliding housing to the storage housing.

6. The leg press machine of claim 5, further including a sliding support plate configured to provide a bridge between the sliding housing and the storage housing so as to enable the weight plate to roll from the sliding housing to the storage housing.

7. The leg press machine of claim 5, wherein the storage housing is configured to be adjustable in height so as to substantially match the height of the sliding housing when the sliding housing is pushed upward along the pair of rails so as to reach a maximum extent of travel along the pair of rails.

8. The leg press machine of claim 5, wherein the frame further includes:

a base including a front end and a rear end; and a pair of vertical support members secured to the front end of the base and projecting upward therefrom, each of the vertical support members having an upper end, the pair of inclined support members of the frame extending between the respective upper ends of the vertical support members and the rear end of the base.

9. A leg press machine with a weight transfer system for reducing exercise resistance while remaining seated, the leg press machine comprising:

a frame having a pair of inclined support members;

a pair of rails, each rail mounted to an inclined support member of the pair of inclined support members;

a sliding cross bar slidably mounted on the pair of rails;

a sliding housing mounted on the sliding cross bar, the sliding housing configured to receive and movably support at least one weight plate along the pair of rails up to a maximum extent of travel along the pair of rails;

a storage housing positioned to receive the weight plate pushed from the sliding housing; and a weight transfer actuator configured to push the weight plate from the sliding housing, and cause the weight plate to roll from the sliding housing to the storage housing, thereby reducing the exercise resistance.

10. The leg press machine of claim 9, further including:

a seat adjustably mounted to the frame so as to accommodate a height of an exerciser.

11. The leg press machine of claim 9, wherein the sliding housing includes:

a movable mount configured to support the weight plate, the movable mount also being configured to be lifted so as to urge the weight plate to begin rolling towards the storage housing.

12. The leg press machine of claim 9, wherein the weight transfer actuator includes:

a fixed bar; a moving bar; and a pair of pivoting links, such that the fixed bar, the moving bar, and the pair of pivoting links define a parallelogram linkage.

13. The leg press machine of claim 12, wherein the moving bar has a top surface configured to releasably engage the push rod.

14. The leg press machine of claim 12, wherein the fixed bar is mounted along one of the inclined support members of the frame.

15. The leg press machine of claim 9, wherein the storage housing is configured to be positioned at a height determined by a maximum extent of travel of the sliding housing.

16. The leg press machine of claim 9, wherein the pair of inclined support members of the frame are slanted at 45°.

17. The leg press machine of claim 9, wherein the weight transfer actuator includes:

a push rod pivotally secured to the movable mount, the push rod being configured to push the weight plate from the sliding housing.

18. The leg press machine of claim 9, wherein the storage housing is positioned at substantially the height reached by the sliding housing when the sliding housing is pushed upward along the pair of rails so as to reach a maximum extent of travel along the pair of rails.

19. The leg press machine of claim 10, wherein the seat adjustably mounted to the frame is configured to be adjusted so that the sliding housing can be pushed upward by an exerciser along the pair of rails so as to reach a maximum extent of travel along the pair of rails when the exerciser extends his or her legs to a maximum extent.

* * * * *